US009042794B1

(12) United States Patent
Hill et al.

(10) Patent No.: US 9,042,794 B1
(45) Date of Patent: May 26, 2015

(54) METHOD AND APPARATUS FOR ALIGNING A BIAS TRANSFER ROLL

(71) Applicant: Xerox Corporation, Norwalk, CT (US)

(72) Inventors: Alun Henry Hill, Welwyn Garden City (GB); John Barry Poxon, Stevenage (GB); Simon Neil Jowett, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/218,636

(22) Filed: Mar. 18, 2014

(51) Int. Cl.
*G03G 15/00* (2006.01)
*G03G 15/01* (2006.01)
*G03G 15/16* (2006.01)

(52) U.S. Cl.
CPC ..... *G03G 15/0131* (2013.01); *G03G 15/161* (2013.01)

(58) Field of Classification Search
CPC ..... G03G 15/0131; G03G 15/161; G03G 15/0194; G03G 2215/0129
See application file for complete search history.

(56) References Cited

U.S. PATENT DOCUMENTS 6,356,735 B1 * 3/2002 Hozumi ..... 399/395
7,551,881 B2 * 6/2009 Iinuma ..... 399/302

* cited by examiner

*Primary Examiner* — David Gray
*Assistant Examiner* — Michael Harrison

(57) ABSTRACT

A method, non-transitory computer readable medium, and apparatus for aligning a bias transfer roll are disclosed. For example, the method detects a position of a paper, determines a position of the bias transfer roll, calculates an offset between the position of the paper and the position of the bias transfer roll and moves the bias transfer roll laterally by an amount of the offset to align the bias transfer roll to the paper.

20 Claims, 5 Drawing Sheets

METHOD AND APPARATUS FOR ALIGNING A BIAS TRANSFER ROLL

The present disclosure relates generally to alignment issues within xerographic printing modules and, more particularly, to a method and apparatus for aligning a bias transfer roll.

BACKGROUND

Current xerographic modules/print cartridges use a biased transfer roll (BTR) foam roller that constantly idles against a photoreceptor to attract toner across to the paper when the paper is in between the BTR and the photoreceptor. When a customer needs to print to the edge of a document, the paper, the image on the drum and the BTR should be in alignment otherwise the BTR becomes contaminated. Contamination of the BTR can cause the residual toner on the BTR to smear toner onto or contaminate the subsequent sheets that contact the BTR, prevent new toner from being attached and contaminate the inside the printer.

One solution currently used is to address the above problem using a software only solution. For example, a small border around the image to be printed may be artificially removed to prevent the image from being printed outside of the paper onto the BTR.

Another currently used solution attempts to address the problem using a mechanical solution that is extremely expensive. For example, paper registration systems can be modified such that each sheet of paper is dynamically aligned to the BTR and photoreceptor prior to transfer. However, current machines with such capability are quite expensive and unaffordable to most businesses.

Another solution may be to periodically clean the BTR between print jobs to remove any residual toner left on the BTR. However, periodic cleaning and maintenance of the BTR to remove residual toner may lead to inefficiencies and a reduction of an overall productivity of the printer.

SUMMARY

According to aspects illustrated herein, there are provided a method, a non-transitory computer readable medium, and an apparatus for aligning a bias transfer roll. One disclosed feature of the embodiments is a method that detects a position of a paper, determines a position of the bias transfer roll, calculates an offset between the position of the paper and the position of the bias transfer roll and moves the bias transfer roll laterally by an amount of the offset to align the bias transfer roll to the paper.

Another disclosed feature of the embodiments is a non-transitory computer-readable medium having stored thereon a plurality of instructions, the plurality of instructions including instructions which, when executed by a processor, cause the processor to perform an operation that detects a position of a paper, determines a position of the bias transfer roll, calculates an offset between the position of the paper and the position of the bias transfer roll and moves the bias transfer roll laterally by an amount of the offset to align the bias transfer roll to the paper.

Another disclosed feature of the embodiments is an apparatus comprising a processor and a computer readable medium storing a plurality of instructions which, when executed by the processor, cause the processor to perform an operation that detects a position of a paper, determines a position of the bias transfer roll, calculates an offset between the position of the paper and the position of the bias transfer roll and moves the bias transfer roll laterally by an amount of the offset to align the bias transfer roll to the paper.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses a method and non-transitory computer-readable medium for aligning a bias transfer roll. As discussed above, current xerographic modules/print cartridges use a biased transfer roll (BTR) foam roller that constantly idles against a photoreceptor to attract toner across to the paper when the paper is in between the BTR and the photoreceptor. When a customer needs to print to the edge of a document, the paper and the BTR should be in alignment otherwise the BTR becomes contaminated. Contamination of the BTR can cause the residual toner on the BTR to smear toner onto or contaminate the subsequent sheets that contact the BTR, prevent new toner from being attached and contaminate the inside the printer.

One embodiment of the present disclosure resolves this problem by calculating a lateral offset between the BTR and the paper and moving the BTR by an amount of the lateral offset. The BTR may be moved laterally, in a direction to the left or a direction to the right, to ensure that the edges of the BTR are aligned with the edges of the paper. As a result, the image may be printed edge to edge on the paper without the need to artificially remove borders on the image and without placing toner on the BTR, which can lead to contamination of future print jobs.

Figure 1:
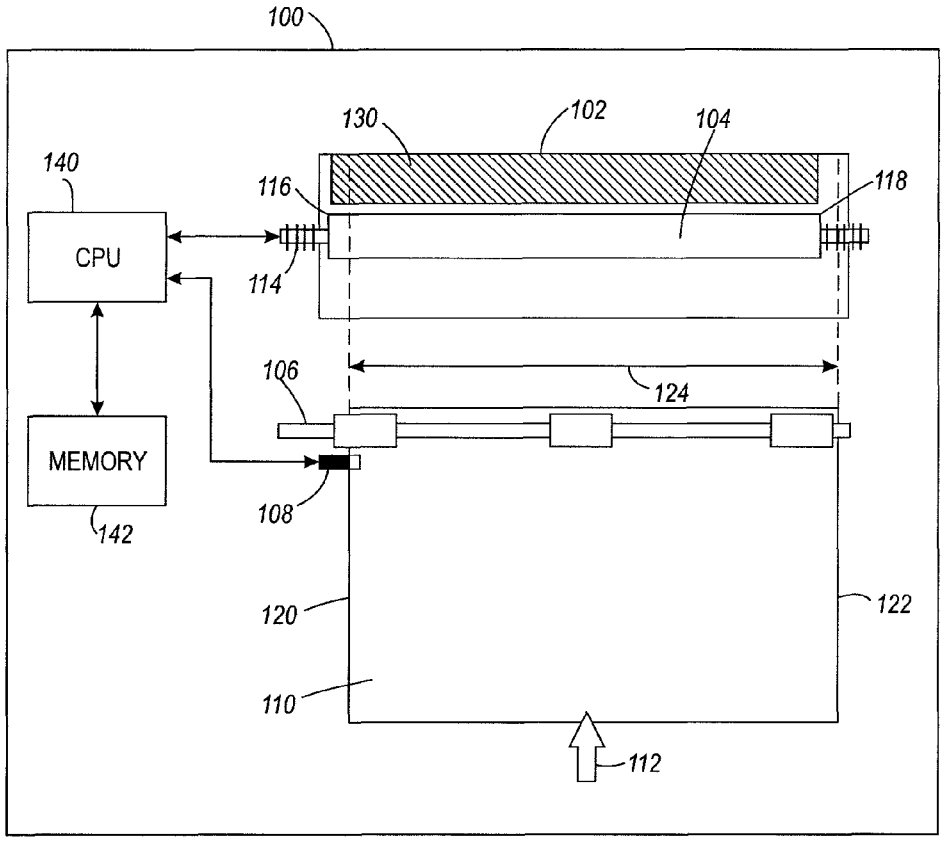
FIG. 1 illustrates an example block diagram of a misaligned bias transfer roll.

FIG. 1 illustrates a multi-function device (MFD) 100 of the present disclosure. The MFD 100 may be any type of printer, copy machine, xerographic printer, and the like. In one embodiment, the MFD 100 may include a photoreceptor 102, a biased transfer roll (BTR) 104, a nip roller 106 and a registration sensor 108. Although only a single registration sensor 108 is illustrated in FIG. 1, it should be noted that two registration sensors 108 (e.g., one on each side) can be deployed. It should be noted that the MFD 100 may include additional components not shown (e.g., multiple sized paper trays, a user interface, additional rollers and internal components, and the like), but has been simplified in FIG. 1 for ease of explanation of the present disclosure.

In one embodiment, as a paper 110 is fed in a paper feed direction 112 to the photoreceptor 102 and the BTR 104 for printing, the paper 110 may be misaligned with the BTR 104 and an image 130 that is to be printed onto the paper 110. A left edge 120 and a right edge 122 of the paper 110 may be misaligned with a left edge 116 and a right edge 118 of the BTR. The misalignment is illustrated by a span 124 of dashed lines. For example, the left edge 116 of the BTR 104 is outside of the span 124. As a result, if the image 130 is printed, some of the toner would miss the paper 110 and fall onto the BTR 104 that is left of the paper 110.

Figure 2:
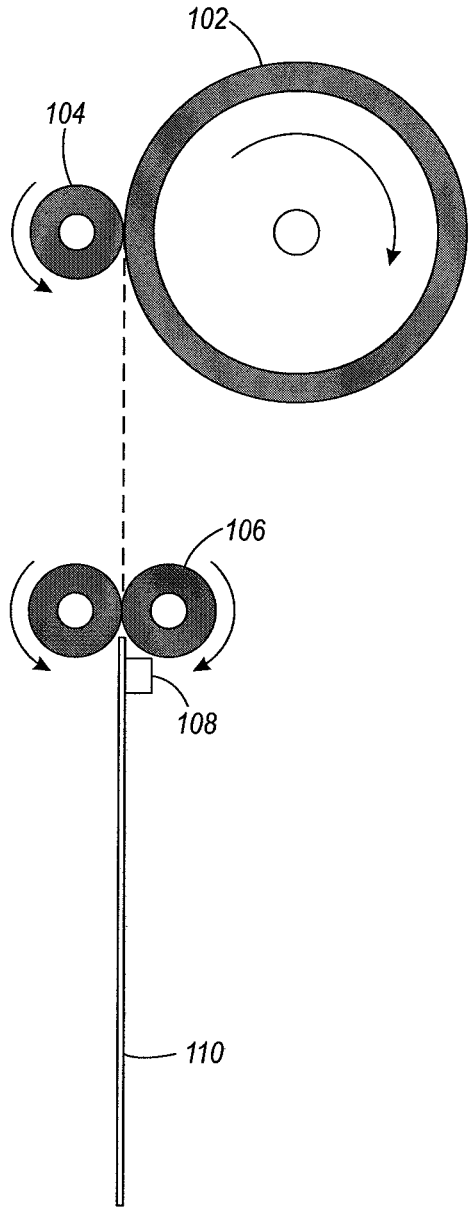
FIG. 2 illustrates an example block diagram of a side view of the bias transfer roll.

FIG. 2 illustrates a side view of FIG. 1. FIG. 2 illustrates how the paper 110 is fed through the nip roller 106 and in between the photoreceptor 102 and the BTR 104. The arrows in FIG. 2 illustrate how the photoreceptor 102, the BTR 104 and the nip roller 106 rotate.

Referring back to FIG. 1, in one embodiment, the BTR 104 and the paper 110 are approximately the same width. The image 130 may be printed on the paper 110 edge to edge. In one embodiment, the BTR 104 is sized to a largest possible sized paper 110 that can be fed to the MFD 100. In such a scenario, if the BTR 104 and the paper 110 are misaligned, when the image 130 is printed edge to edge on the paper 110 some of the toner may miss the paper 110 and be placed onto the BTR 104. The toner on the BTR 104 can cause contamination to other print jobs (e.g., smearing toner on the back of a subsequent piece of paper 110 or block new toner that needs to be applied) or allow toner to contaminate other portions within the MFD 100.

One embodiment of the present disclosure resolves the misalignment problem by allowing the BTR 104 to move laterally (e.g., left and right) via a mechanical means 114 to align properly with the paper 110. In one embodiment, the mechanical means 114 may be a threaded lead screw that allows the BTR 104 to rotate around the threaded lead screw laterally left or right. For example, the BTR 104 may be enclosed in a housing that has a rotating portion within the housing. As the rotating portion rotates around the screw the BTR 104 and the housing would move in the corresponding direction (e.g., either left or right). In another embodiment, the mechanical means 114 may be a lever. The listed mechanical means 114 are only examples and should not be considered limiting.

In one embodiment, the registration sensor 108 may detect when a lead edge of the paper is about to enter the nip roller 106. The registration sensor 108 may be used with either an edge register system (e.g., to edge align the BTR 104 to the paper 110) or a center register system (e.g., to center align the BTR 104 to the paper 110). The registration sensor 108 may detect a position of an edge of the paper 110 (e.g., a left edge 120 if the registration sensor 108 is located on a left side or a right edge 122 if the registration sensor 108 is located on a right side). The position of the edge of the paper 110 may be sent to a processor 140 and recorded in a memory 142.

When the registration sensor 108 detects the lead edge of the paper, the processor also determines a position of an edge of the BTR 104 (e.g., a left edge 116 or a right edge 118) and may record the position of the BTR 104 in the memory 142. The processor 140 uses the position of the edge of the paper 110 and the position of the edge of the BTR 104 to calculate an offset. In one embodiment, the offset may be a difference between the position of the edge of the BTR 104 and the position of the same edge of the paper 110. For example, if the left edge 116 of the BTR 104 is measured, the offset would be calculated between the left edge 116 of the BTR 104 and the left edge 120 of the paper 110.

The processor 140 may then send a signal to the BTR 104 to cause the BTR 104 to be moved laterally by an amount of the offset in a proper direction (e.g., either left or right). In one embodiment, the amount may be based on the mechanical means 114 used to move the BTR 104. For example, if a lead screw is used, the amount may be a certain number of rotations. In another example, if a lever is used, the amount may be a measurement of the actual distance (e.g., millimeters (mm), centimeters (cm), inches (in), and the like). In another example, if a rod of the BTR 104 is slotted, the amount may be a number of slots, and so forth.

In one embodiment, a tolerance threshold may be stored in the memory 142 and may be used to ensure that the BTR 104 is properly aligned with the paper 110. For example, an exact alignment may be difficult. Thus, a tolerance may be employed. To illustrate by example, as long as the offset is within 0.2 mm, the BTR 104 may be considered to be "aligned" with the paper 110. In one embodiment, the alignment may be an iterative process. For example, after the BTR 104 is moved, the processor 140 may obtain a position of the edge of the paper 110 and the edge of the BTR 104 and recalculate the offset. If the amount of the offset is outside of the tolerance threshold, the BTR 104 may be moved again and the process may be repeated until the BTR 104 and the paper 110 are aligned within the tolerance threshold.

In one embodiment, the mechanical means 114 of the BTR 104 and the registration sensor 108 may be calibrated with the CPU 140. For example, the farthest left position of the BTR 104 may be aligned with a farthest left edge of the registration sensor 108. In addition, the farthest left position of the BTR 104 may be position zero and move incrementally (e.g., based on the mechanical means 114, the increments may be rotations, slots, distance units, and the like) to the right. Similarly, the farthest left edge of the registration sensor 108 may be zero and the position may be measured in the same increments used for the mechanical means 114 moving to the right. It should be noted that the alignment may also be performed on the farthest right position of the BTR 104 and the farthest right side of the registration sensor 108 if the registration sensor 108 is located on a right side.

In one embodiment, in addition to moving the BTR 104, the image 130 that is to be printed may also be aligned with the BTR 104 and the paper 110. For example, the position of the image 130 on the photoreceptor 102 may be recorded by the processor 140. The offset between the position of the image 130 and the position of the paper 110 may be calculated similar to the calculating the offset between the BTR 104 and the paper 110, as discussed above.

Figure 3:
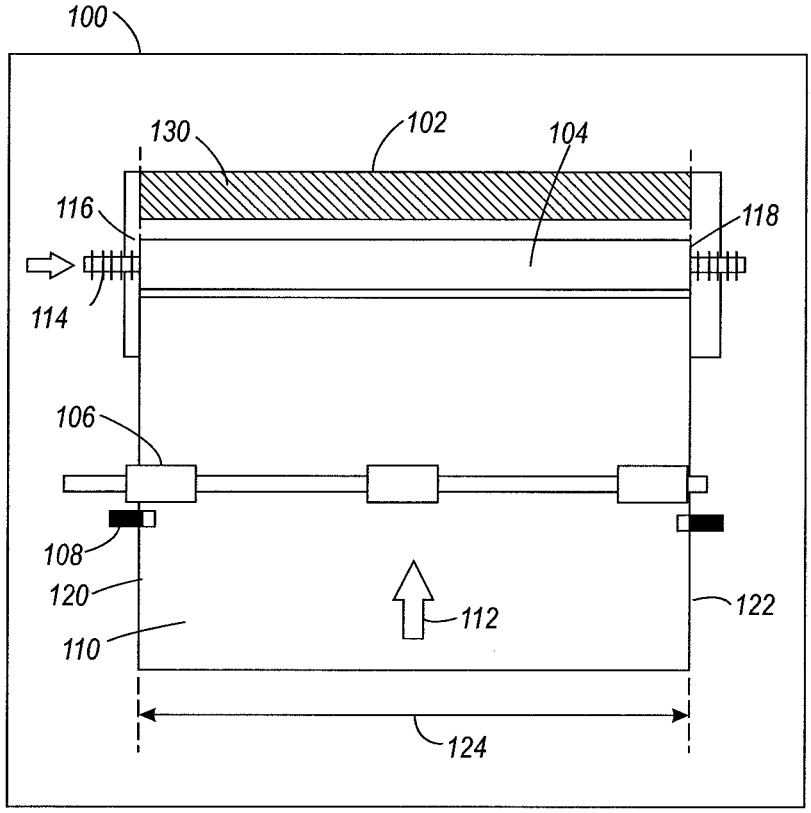
FIG. 3 illustrates an example block diagram of an aligned bias transfer roll.

FIG. 3 illustrates an example of an aligned image 130, BTR 104 and paper 110 after the BTR 104 and/or the image 130 is moved. For example, the left edge 116 and right edge 118 of the BTR 104 and the left edge 120 and the right edge 122 of the paper 110 are aligned and are both between the span 124. In other words, the BTR 104 was moved to the right in an amount of the offset calculated by the processor 140, as discussed above. Alternatively, the BTR 104 may be moved to the left if the offset is calculated based from the perspective of the right edge 118 of the BTR 104 and the right edge 122 of the paper 110. In one embodiment, the image 130 may also be aligned with the BTR 104 and the paper 110 as illustrated in FIG. 3. In one embodiment, the alignment may not be exact. In other words, the left edge 116 and the right edge 118 of the BTR 104 and the left edge 120 and the right edge 122 of the paper 110 may be aligned to be within the tolerance threshold.

As a result, the image 130 is printed edge to edge on the paper 110 without requiring any artificial software modifications being performed on the image 130 (e.g., reducing a portion of the border around the image 130). In addition, the image 130 is printed edge to edge on the paper 110 without allowing any toner or a very minimal amount of toner to reach the BTR 104. Thus, toner contamination of subsequent print jobs (e.g., toner on the BTR 104 smearing on the back of subsequent papers fed to the BTR 104 and the photoreceptor 102) and the toner contamination within the MFD 100 is minimized.

In addition, moving the BTR 104 for alignment with the paper 110 may also provide advantages in terms of producing a uniform image. For example, if the MFD 100 is a center register system and the paper 110 is smaller than the BTR 104, the paper 110 and the image 130 may be aligned to the center of the BTR 104. As a result, the same portion of the BTR 104 would be used to print the image 130 onto the smaller sized paper 110 each time. This would produce a uniform image as opposed to using a different portion of the BTR 104 for each image 130 that is printed onto papers 110 that are differently aligned for each print.

Figure 4:
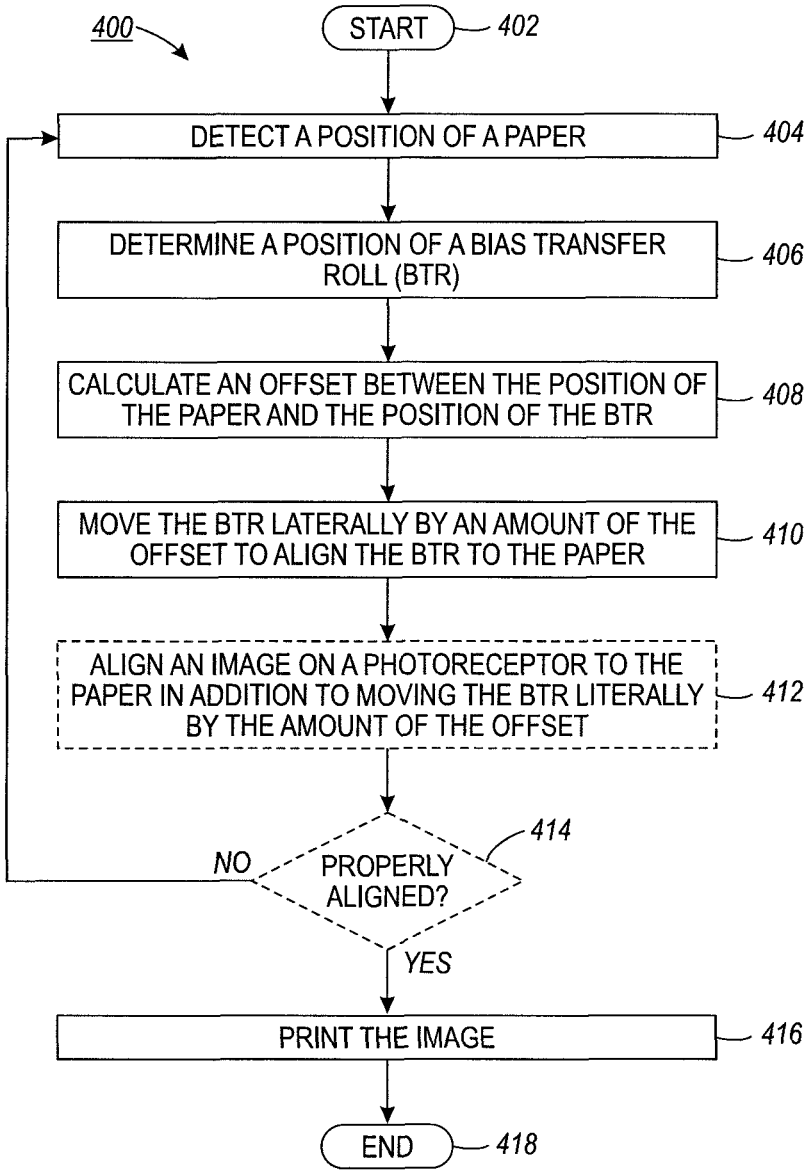
FIG. 4 illustrates an example flowchart of one embodiment of a method for aligning a bias transfer roll.
Figure 5:
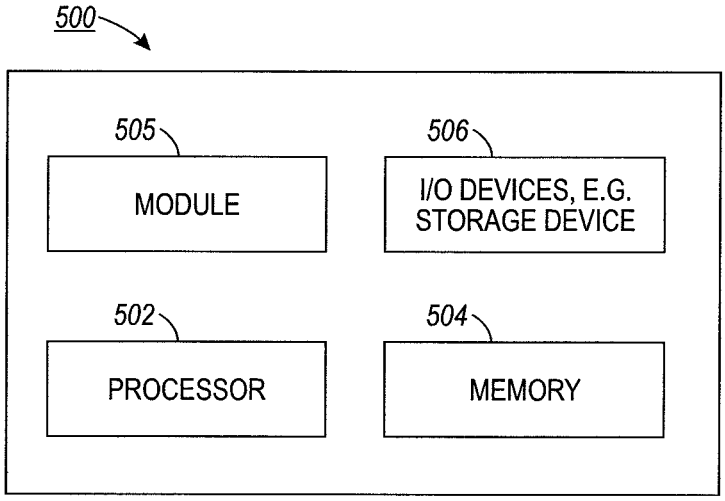
FIG. 5 illustrates a high-level block diagram of a general-purpose computer suitable for use in performing the functions described herein.

FIG. 4 illustrates a flowchart of a method 400 for aligning a bias transfer roll. In one embodiment, one or more steps or operations of the method 400 may be performed by the multi-function device 100 or a general-purpose computer as illustrated in FIG. 5 and discussed below.

At step 402 the method 400 begins. At step 404, the method 400 detects a position of the paper. In one embodiment, the position of the paper may be detected by a registration sensor located before a registration nip roller. In one embodiment, a single registration sensor may be used on one side. Alternatively, in another embodiment, two registrations sensors may be used (e.g., one registration sensor on each side).

In one embodiment, the position may be a position of an edge of the paper. The position may be relative to a calibrated beginning point of the registration sensor (e.g., if the registration sensor is on a left side, the farthest left side of the registration sensor would be 0 and the position of the edge of the paper may be determined relative to the 0 position).

At step 406, the method 400 determines a position of a BTR. In one embodiment, the position may be a position of an edge of the BTR. The position may be relative to a calibrated beginning point of the BTR (e.g., if the BTR is calibrated to begin on a left side, the position of the left edge of the BTR when the BTR is moved to a farthest left side would be 0 and the position of the edge of the BTR may be determined relative to the 0 position).

At step 408, the method 400 calculates an offset between the position of the paper and the position of the BTR. For example, a difference in a position of the BTR and the position of the paper may be calculated. In one embodiment, a difference in an edge of the BTR and an edge of the paper may be calculated. In one embodiment, the same edge may be used to calculate the offset (e.g., a difference in a position of a left edge of the BTR and a position of a left edge of the paper or vice versa).

At step 410, the method 400 moves the BTR laterally by an amount of the offset to align the BTR to the paper. In one embodiment, moving the BTR laterally may comprise moving the BTR in a right direction or a left direction.

In one embodiment, the amount of the offset that is calculated in the step 408 may be in an amount associated with a mechanical means of movement that is used and/or calibrated for the BTR. For example, if the mechanical means is a threaded lead screw, the amount may be a number of rotations equivalent to an amount of distance that needs to be moved. For example, if the BTR needs to be moved 2 mm and each rotation moves 1 mm, the amount may be 2 rotations. If a lever is used, the amount may simply be 2 mm and the BTR may be moved the appropriate distance.

At optional step 412, the method 400 aligns an image on a photoreceptor to the paper in addition to moving the BTR laterally by the amount of the offset. In one embodiment, the image may be laterally moved on the photoreceptor to also be aligned with the BTR and the paper. Aligning the image may provide an additional assurance that toner will not be applied to the BTR that could lead to contamination.

At optional step 414, the method 400 determines if there is a proper alignment. For example, it may be determined if the BTR is properly aligned with the paper. In one embodiment, a tolerance threshold may be used to determine if the BTR and the paper are properly aligned. In one embodiment, if the image is also moved, it may be determined if the image, the BTR and the paper are properly aligned with the tolerance threshold. If the BTR and the paper or the BTR, image and the paper are not properly aligned, the method 400 may return to step 404 and iteratively repeat the steps 404-410 and optionally step 412 until there is proper alignment.

If there is proper alignment at the optional step 414, the method 400 may proceed to step 416. At step 416, the method 400 prints the image. For example, the image may be printed edge to edge on the paper without putting any toner on the BTR.

The method 400 may then proceed to step 418. At step 418, the method 400 ends.

It should be noted that although not explicitly specified, one or more steps, functions, or operations of the method 400 described above may include a storing, displaying and/or outputting step as required for a particular application. In other words, any data, records, fields, and/or intermediate results discussed in the methods can be stored, displayed, and/or outputted to another device as required for a particular application. Furthermore, steps, functions, or operations in FIG. 4 that recite a determining operation, or involve a decision, do not necessarily require that both branches of the determining operation be practiced. In other words, one of the branches of the determining operation can be deemed as an optional step.

FIG. 5 depicts a high-level block diagram of a general-purpose computer suitable for use in performing the functions described herein. As depicted in FIG. 5, the system 500 comprises one or more hardware processor elements 502 (e.g., a central processing unit (CPU), a microprocessor, or a multi-core processor), a memory 504, e.g., random access memory (RAM) and/or read only memory (ROM), a module 505 for aligning a bias transfer roll, and various input/output devices 506 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the general-purpose computer may employ a plurality of processor elements. Furthermore, although only one general-purpose computer is shown in the figure, if the method(s) as discussed above is implemented in a distributed or parallel manner for a particular illustrative example, i.e., the steps of the above method(s) or the entire method(s) are implemented across multiple or parallel general-purpose computers, then the general-purpose computer of this figure is intended to represent each of those multiple general-purpose computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a general purpose computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 505 for aligning a bias transfer roll (e.g., a software program comprising computer-executable instructions) can be loaded into memory 504 and executed by hardware processor element 502 to implement the steps, functions or operations as discussed above in connection with the exemplary method 400. Furthermore, when a hardware processor executes instructions to perform "operations", this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 505 for aligning a bias transfer roll (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method for aligning a bias transfer roll, comprising:
detecting, by a processor, a position of a paper;
determining, by the processor, a position of the bias transfer roll;
calculating, by the processor, an offset between the position of the paper and the position of the bias transfer roll; and
moving, by the processor, the bias transfer roll laterally by an amount of the offset to align the bias transfer roll to the paper.

2. The method of claim 1, further comprising:
aligning, by the processor, an image on a photoreceptor to the paper in addition to moving the bias transfer roll laterally by the amount of the offset.

3. The method of claim 1, wherein the position of the paper is detected by a registration sensor.

4. The method of claim 3, wherein the registration sensor is part of an edge register system or a center register system.

5. The method of claim 3, wherein the registration sensor is located before a registration nip roller.

6. The method of claim 1, wherein the bias transfer roller is moved laterally via a mechanical means.

7. The method of claim 6, wherein the mechanical means comprises a lead screw, wherein the bias transfer roll is rotated around the lead screw to move laterally.

8. The method of claim 1, wherein the bias transfer roll is approximately a same width as the paper.

9. A non-transitory computer-readable medium storing a plurality of instructions which, when executed by a processor, cause the processor to perform operations for aligning a bias transfer roll, the operations comprising:
detecting a position of a paper;
determining a position of the bias transfer roll;
calculating an offset between the position of the paper and the position of the bias transfer roll; and
moving the bias transfer roll laterally by an amount of the offset to align the bias transfer roll to the paper.

10. The non-transitory computer-readable medium of claim 9, further comprising:
aligning an image on a photoreceptor to the paper in addition to moving the bias transfer roll laterally by the amount of the offset.

11. The non-transitory computer-readable medium of claim 9, wherein the position of the paper is detected by a registration sensor.

12. The non-transitory computer-readable medium of claim 11, wherein the registration sensor is part of an edge register system or a center register system.

13. The non-transitory computer-readable medium of claim 11, wherein the registration sensor is located before a registration nip roller.

14. The non-transitory computer-readable medium of claim 9, wherein the bias transfer roller is moved laterally via a mechanical means.

15. The non-transitory computer-readable medium of claim 14, wherein the mechanical means comprises a lead screw, wherein the bias transfer roll is rotated around the lead screw to move laterally.

16. The non-transitory computer-readable medium of claim 9, wherein the bias transfer roll is approximately a same width as the paper.

17. A method for aligning a bias transfer roll, comprising:
detecting, by a processor, a position of an edge of a paper via at least one registration sensor in communication with the processor;
determining, by the processor, a position of an edge of the bias transfer roll;
calculating, by the processor, an offset between the position of the edge of the paper and the position of the edge of the bias transfer roll;
moving, by the processor, the bias transfer roll laterally by an amount of the offset to align the edge of the bias transfer roll to the edge of the paper; and
printing, by the processor, the image onto the paper using a same part of the bias transfer roll as used for all other printing after the moving to provide a uniform image across different prints.

18. The method of claim 17, further comprising:
aligning, by the processor, an image to be printed on the paper on a photoreceptor to the paper in addition to moving the bias transfer roll laterally by the amount of the offset.

19. The method of claim 17, wherein the bias transfer roller is moved laterally via a mechanical means.

20. The method of claim 19, wherein the mechanical means comprises a lead screw, wherein the bias transfer roll is rotated around the lead screw to move laterally.

* * * * *